United States Patent [19]

Moore et al.

[11] Patent Number: 4,585,066

[45] Date of Patent: Apr. 29, 1986

[54] WELL TREATING PROCESS FOR INSTALLING A CABLE BUNDLE CONTAINING STRANDS OF CHANGING DIAMETER

[75] Inventors: Boyd B. Moore; Peter Vanmeurs; Cor F. Van Egmond, all of Houston, Tex.

[73] Assignee: Shell Oil Company, Houston, Tex.

[21] Appl. No.: 676,743

[22] Filed: Nov. 30, 1984

[51] Int. Cl.[4] ..... E21B 19/22

[52] U.S. Cl. ..... 166/385; 166/77; 166/302

[58] Field of Search ..... 166/385, 244 R, 302, 166/77, 85, 75 R, 65 R, 378, 379, 57, 58, 60, 61; 254/900, 286, 283, 278; 219/277, 278; 242/54 R

[56] References Cited

U.S. PATENT DOCUMENTS

| | | | |
|---|---|---|---|
| 2,720,327 | 10/1955 | Bain | 254/278 |
| 2,781,851 | 2/1957 | Smith | 166/60 |
| 3,131,763 | 5/1964 | Kunetka et al. | 166/60 |
| 3,170,519 | 2/1965 | Haagensen | 166/65 R |
| 3,381,766 | 5/1968 | Bannister | 166/65 R |
| 4,442,903 | 4/1984 | Schutt et al. | 166/385 |

FOREIGN PATENT DOCUMENTS

| | | | |
|---|---|---|---|
| 0910034 | 5/1946 | France | 219/278 |
| 0017845 | 2/1981 | Japan | 242/54 R |

*Primary Examiner*—James A. Leppink
*Assistant Examiner*—Hoang C. Dang

[57] ABSTRACT

A bundle of spoolable power supplying and heating cables and at least one weight-supporting strand for forming an assembly for electrically heating or heating and logging a long interval of subterranean earth formations is installed within a well by spooling superposed flat layers of those strands and an interspersed flexible band on a drum substantially as narrow as the layers, while interconnecting the power supplying and heating cables on the drum, and then unspooling the strands into the well while intermittently banding them into bundles and concurrently respooling the flexible band on a different drum.

3 Claims, 5 Drawing Figures

FIG. 2
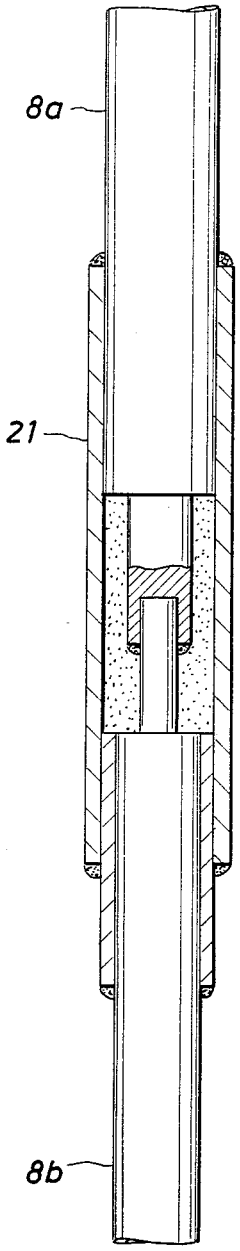
FIG. 3
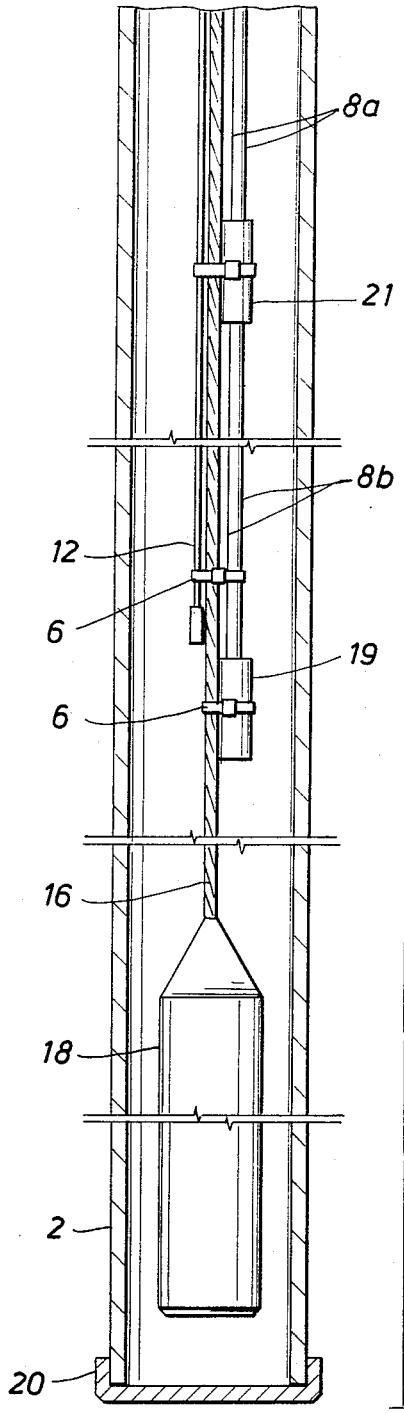
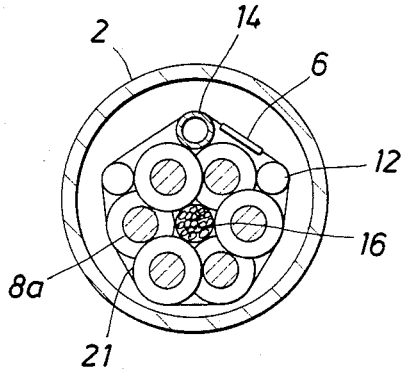
FIG. 4
FIG. 5
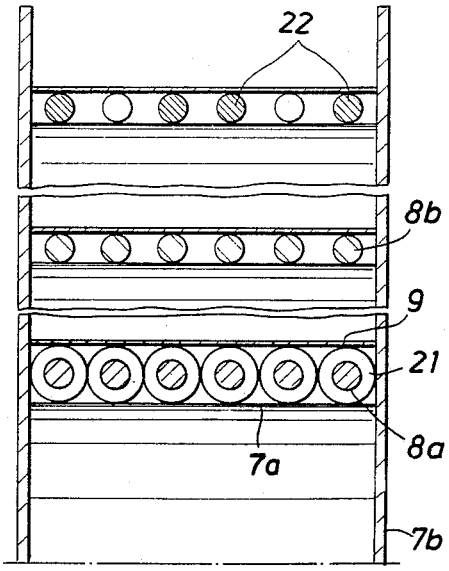

WELL TREATING PROCESS FOR INSTALLING A CABLE BUNDLE CONTAINING STRANDS OF CHANGING DIAMETER

CROSS REFERENCE TO RELATED APPLICATIONS

Commonly assigned patent application Ser. No. 597,764 filed Apr. 6, 1984, by P. VanMeurs and C. F. Van Egmond relates to electrical well heaters comprising metal-sheathed, mineral-insulated cables capable of heating long intervals of subterranean earth formations at high temperatures, with the patterns of heat generating resistances with distance along the cables being arranged in correlation with the patterns of heat conductivity with depth within the earth formations to transmit heat uniformly into the earth formations.

Commonly assigned patent application Ser. No. 658,238 filed Oct. 5, 1984 by G. L. Stegemeier, P. VanMeurs and C. F. Van Egmond relates to measuring patterns of temperature with depths along subterranean intervals by extending a heat-stable spoolable conduit from a surface location to within the interval and logging the temperature with a telemetering temperature sensing means while moving the measuring means within the conduit by remotely controllable cable spooling means capable of keeping the measuring means in substantial thermal equilibrium with the surrounding temperatures throughout the interval being logged.

Commonly assigned patent application Ser. No. 666,528 filed Oct. 30, 1984, by C. F. Van Egmond and P. VanMeurs relates to installing within a well an electrical heater which contains at least one metal-sheathed, mineral-insulated electrical power supply cable connected in series with a similar heating cable, while also installing weight supporting and performance monitoring elements within the well.

The disclosures of the above patent applications are incorporated herein by reference.

BACKGROUND OF THE INVENTION

The present invention relates to a well treating process for installing a bundle of strands inclusive of at least two strands having different diameters in different locations along their lengths. More particularly, the invention relates to installing an electrical heater capable of heating a long interval of subterranean earth formation and, where desired, being arranged to facilitate logging the temperature of the heated zone through a spoolable well conduit extending from a surface location to the interval being heated.

It is known that benefits can be obtained by heating intervals of subterranean earth formations to relatively high temperatures for relatively long times. Such benefits may include the pyrolyzing of an oil shale formation, the consolidating of unconsolidated reservoir formations, the formation of large electrically conductive carbonized zones capable of operating as electrodes within reservoir formations, the thermal displacement of hydrocarbons derived from oils or tars into production locations, etc. Prior processes for accomplishing such results are contained in patents such as the following, all of which are U.S. patents. U.S. Pat. No. 2,732,195 describes heating intervals of 20 to 30 meters within subterranean oil shales to temperatures of 500° to 1000° C. with an electrical heater having iron or reuseable chromium alloy resistors. U.S. Pat. No. 2,781,851 by G. A. Smith describes using a mineral-insulated and copper-sheathed low resistance heater cable containing three copper conductors at temperatures up to 250° C. for preventing hydrate formation, during gas production, with that heater being mechanically supported by steel bands and surrounded by an oil bath for preventing corrosion. U.S. Pat. No. 3,104,705 describes consolidating reservoir sands by heating residual hydrocarbons within them until the hydrocarbons solidify, with "any heater capable of generating sufficient heat" and indicates that an unspecified type of an electrical heater was operated for 25 hours at 1570° F. U.S. Pat. No. 3,131,763 describes an electrical heater for initiating an underground combustion reaction within a reservoir and describes a heater with resistance wire helixes threaded through insulators and arranged for heating fluids, such as air, being injected into a reservoir. U.S. Pat. No. 4,415,034 describes a process for forming a coked-zone electrode in an oil-containing reservoir formation by heating fluids in an uncased borehole at a temperature of up to 1500° F. for as long as 12 months.

SUMMARY OF THE INVENTION

The present invention relates to an improvement in a process in which a bundle of strands including at least one weight supporting strand, and at least two strands which have differing thicknesses along different portions of their length, are installed within a well. The strands of differing thicknesses are spooled onto a drum having flanges separated by a distance near but not less than the width of a layer of those strands with the thickest portions side-by-side. A flexible band which is capable of extending substantially between the drum flanges and bridging across the upper portions of a layer of the strands of differing thicknesses is spooled onto a drum between side-by-side layers of those strands, to form superposed substantially flat surfaces for supporting each of those layers. The strands of differing thicknesses are subsequently unspooled into the well while the flexible band is being respooled onto a different drum. A weight-supporting strand is concurrently unspooled from a different drum so that it enters the well along with the strands of differing thicknesses. The strands entering the well are periodically banded into contact with each other to an extent such that the friction between them and the weight-supporting strand is sufficient to support the weight of the strands between the bands.

BRIEF DESCRIPTION OF THE DRAWINGS

FIG. 2 shows a portion of an electrical heater assembly installed within a well by the present invention.

FIG. 3 shows junctions between metal-sheathed electrical cables suitable for use as strands of differing diameter to be installed by the present invention.

FIG. 4 shows a banding together of a bundle of strands in a manner suitable for use in the present invention.

FIG. 5 is a schematic illustration exemplifying a drum on which strands of differing thicknesses are spooled in accordance with the present invention.

DESCRIPTION OF THE INVENTION

Figure 1:
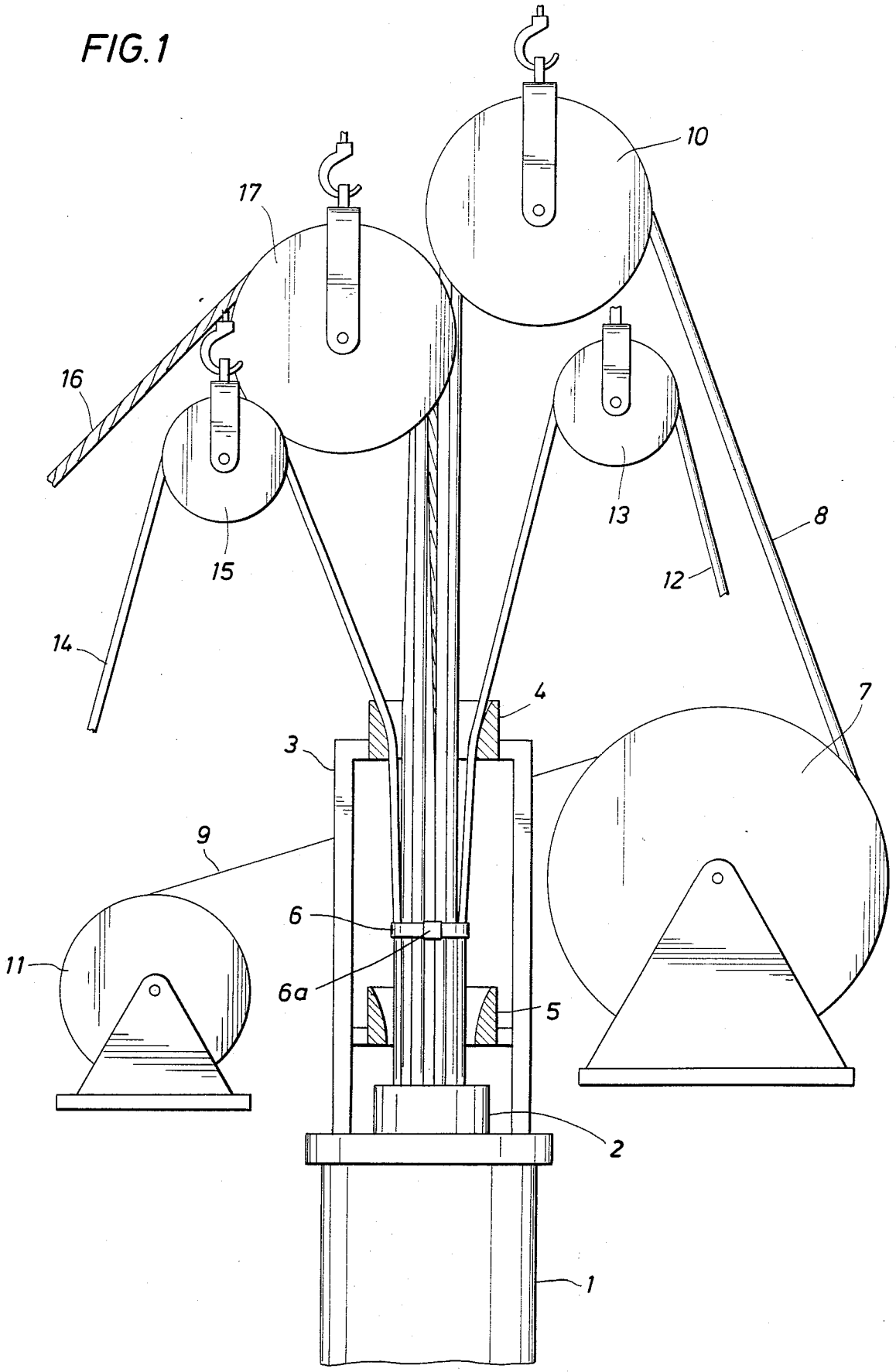
FIG. 1 is a schematic illustration of a bundle of strands being inserted into a well in accordance with the present invention.

Where spoolable strands have different thicknesses along different portions of their length (with those por-

WELL TREATING PROCESS FOR INSTALLING A CABLE BUNDLE CONTAINING STRANDS OF CHANGING DIAMETER

CROSS REFERENCE TO RELATED APPLICATIONS

Commonly assigned patent application Ser. No. 597,764 filed Apr. 6, 1984, by P. VanMeurs and C. F. Van Egmond relates to electrical well heaters comprising metal-sheathed, mineral-insulated cables capable of heating long intervals of subterranean earth formations at high temperatures, with the patterns of heat generating resistances with distance along the cables being arranged in correlation with the patterns of heat conductivity with depth within the earth formations to transmit heat uniformly into the earth formations.

Commonly assigned patent application Ser. No. 658,238 filed Oct. 5, 1984 by G. L. Stegemeier, P. VanMeurs and C. F. Van Egmond relates to measuring patterns of temperature with depths along subterranean intervals by extending a heat-stable spoolable conduit from a surface location to within the interval and logging the temperature with a telemetering temperature sensing means while moving the measuring means within the conduit by remotely controllable cable spooling means capable of keeping the measuring means in substantial thermal equilibrium with the surrounding temperatures throughout the interval being logged.

Commonly assigned patent application Ser. No. 666,528 filed Oct. 30, 1984, by C. F. Van Egmond and P. VanMeurs relates to installing within a well an electrical heater which contains at least one metal-sheathed, mineral-insulated electrical power supply cable connected in series with a similar heating cable, while also installing weight supporting and performance monitoring elements within the well.

The disclosures of the above patent applications are incorporated herein by reference.

BACKGROUND OF THE INVENTION

The present invention relates to a well treating process for installing a bundle of strands inclusive of at least two strands having different diameters in different locations along their lengths. More particularly, the invention relates to installing an electrical heater capable of heating a long interval of subterranean earth formation and, where desired, being arranged to facilitate logging the temperature of the heated zone through a spoolable well conduit extending from a surface location to the interval being heated.

It is known that benefits can be obtained by heating intervals of subterranean earth formations to relatively high temperatures for relatively long times. Such benefits may include the pyrolyzing of an oil shale formation, the consolidating of unconsolidated reservoir formations, the formation of large electrically conductive carbonized zones capable of operating as electrodes within reservoir formations, the thermal displacement of hydrocarbons derived from oils or tars into production locations, etc. Prior processes for accomplishing such results are contained in patents such as the following, all of which are U.S. patents. U.S. Pat. No. 2,732,195 describes heating intervals of 20 to 30 meters within subterranean oil shales to temperatures of 500° to 1000° C. with an electrical heater having iron or reuseable chromium alloy resistors. U.S. Pat. No. 2,781,851 by G. A. Smith describes using a mineral-insulated and copper-sheathed low resistance heater cable containing three copper conductors at temperatures up to 250° C. for preventing hydrate formation, during gas production, with that heater being mechanically supported by steel bands and surrounded by an oil bath for preventing corrosion. U.S. Pat. No. 3,104,705 describes consolidating reservoir sands by heating residual hydrocarbons within them until the hydrocarbons solidify, with "any heater capable of generating sufficient heat" and indicates that an unspecified type of an electrical heater was operated for 25 hours at 1570° F. U.S. Pat. No. 3,131,763 describes an electrical heater for initiating an underground combustion reaction within a reservoir and describes a heater with resistance wire helixes threaded through insulators and arranged for heating fluids, such as air, being injected into a reservoir. U.S. Pat. No. 4,415,034 describes a process for forming a coked-zone electrode in an oil-containing reservoir formation by heating fluids in an uncased borehole at a temperature of up to 1500° F. for as long as 12 months.

SUMMARY OF THE INVENTION

The present invention relates to an improvement in a process in which a bundle of strands including at least one weight supporting strand, and at least two strands which have differing thicknesses along different portions of their length, are installed within a well. The strands of differing thicknesses are spooled onto a drum having flanges separated by a distance near but not less than the width of a layer of those strands with the thickest portions side-by-side. A flexible band which is capable of extending substantially between the drum flanges and bridging across the upper portions of a layer of the strands of differing thicknesses is spooled onto a drum between side-by-side layers of those strands, to form superposed substantially flat surfaces for supporting each of those layers. The strands of differing thicknesses are subsequently unspooled into the well while the flexible band is being respooled onto a different drum. A weight-supporting strand is concurrently unspooled from a different drum so that it enters the well along with the strands of differi[illegible]esses. The strands entering the well are pe[illegible]ded into contact with each other to an e[illegible] the friction between them and the wei[illegible]rting strand is sufficient to support the weig[illegible]he strands between the bands.

BRIEF DESCRIPTION OF THE DRAWINGS

FIG. 1 is a schematic illustration of a bundle of strands being inserted into a well in accordance with the present invention.

FIG. 2 shows a portion of an electrical heater assembly installed within a well by the present invention.

FIG. 3 shows junctions between metal-sheathed electrical cables suitable for use as strands of differing diameter to be installed by the present invention.

FIG. 4 shows a banding together of a bundle of strands in a manner suitable for use in the present invention.

FIG. 5 is a schematic illustration exemplifying a drum on which strands of differing thicknesses are spooled in accordance with the present invention.

DESCRIPTION OF THE INVENTION

Where spoolable strands have different thicknesses along different portions of their length (with those porof power supply cables leading to the uppermost heater can be occupied by spacer strands such as strands 22. Then, during the running-in of the electrical cables into a well, such spacer strands can be respooled onto a separate drum in a manner similar to the respooling of the flexible bands 9.

What is claimed is:

1. In a well treating process in which a bundle of strands which includes at least one weight-supporting strand and at least two strands having differing thicknesses along different portions of their length are inserted into a well, an improvement for minimizing the number of spooling means needed for equalizing the length of strands inserted, comprising:

supporting the strands of differing thicknesses on a single drum having flanges spaced close to, but slightly greater than, the width of a layer of those strands with their thickest portions side-by-side;

spooling a flexible band which is (a) capable of extending substantially between the drum flanges and (b) bridging across the upper portions of a side-by-side layer of strands of differing thicknesses to form a substantially flat surface for receiving an additional layer of the strands;

unspooling the strands of differing thicknesses into the well while respooling a flexible band onto a separate spooling means;

moving said weight-supporting strand and other strands of said bundle into the well along with the strands of differing thickness; and banding the strands being moved into the well into contact with each other so that the frictional contact with the weight-supporting strand is sufficient to support the weight of the strands between the bands.

2. The process of claim 1 in which the strands of differing thicknesses are end-to-end connected sections of metal-sheathed, mineral-insulated electrical power supplying and heating cables.

3. The process of claim 1 in which the bundle of strands moving into the well includes a spoolable pipe string.

* * * * *